US010408518B2

(12) United States Patent
Matsukura et al.

(10) Patent No.: US 10,408,518 B2
(45) Date of Patent: Sep. 10, 2019

(54) REFRIGERATING MACHINE AND CONTROL METHOD THEREFOR

(71) Applicant: MITSUBISHI HEAVY INDUSTRIES THERMAL SYSTEMS, LTD., Tokyo (JP)

(72) Inventors: Noriyuki Matsukura, Tokyo (JP); Naoya Miyoshi, Tokyo (JP); Hirotaka Tanimura, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 0 days.

(21) Appl. No.: 15/574,612

(22) PCT Filed: Jun. 30, 2016

(86) PCT No.: PCT/JP2016/069482
§ 371 (c)(1),
(2) Date: Nov. 16, 2017

(87) PCT Pub. No.: WO2017/038232
PCT Pub. Date: Mar. 9, 2017

(65) Prior Publication Data

US 2018/0209709 A1 Jul. 26, 2018

(30) Foreign Application Priority Data

Aug. 31, 2015 (JP) ..... 2015-170703

(51) Int. Cl.
*F25B 49/02* (2006.01)
*F25B 1/00* (2006.01)
(Continued)

(52) U.S. Cl.
CPC ..... *F25B 49/022* (2013.01); *F25B 1/00* (2013.01); *F25B 25/005* (2013.01); *F25B 43/04* (2013.01);
(Continued)

(58) Field of Classification Search
CPC ..... F25B 1/00; F25B 1/053; F25B 25/005; F25B 39/04; F25B 43/04; F25B 43/043;
(Continued)

(56) References Cited

U.S. PATENT DOCUMENTS

2006/0048540 A1* 3/2006 Voss ..... B01D 5/0009 62/606
2017/0219260 A1* 8/2017 Togano ..... F25B 43/043
2018/0066871 A1* 3/2018 Matsukura ..... C09K 5/04

FOREIGN PATENT DOCUMENTS

JP 55-172774 U 12/1980
JP 59-40775 U 3/1984
(Continued)

OTHER PUBLICATIONS

International Search Report (Form PCT/ISA/210) for International Application No. PCT/JP2016/069482, dated Sep. 20, 2016, with English translation.
(Continued)

*Primary Examiner* — Marc E Norman
(74) *Attorney, Agent, or Firm* — Birch, Stewart, Kolasch & Birch, LLP

(57) ABSTRACT

This refrigerating machine is equipped with: a turbocompressor which compresses a refrigerant; a condenser which is equipped with one or more pipe groups configured from a plurality of heat transfer pipes through which cooling water flows, and condenses the refrigerant compressed by the turbocompressor; an expansion valve which causes the refrigerant condensed by the condenser to expand; an evapo-
(Continued)

rator which causes the refrigerant expanded by the expansion valve to evaporate; a temperature sensor which detects cooling water exit temperature, which is the temperature of the cooling water flowing from at least one of the heat transfer pipes constituting the pipe group(s); and a control unit which determines, on the basis of the detection temperature of the temperature sensor, air bleeding start conditions for starting an air bleeding operation to bleed and discharge air to the outside.

14 Claims, 7 Drawing Sheets

(51) Int. Cl.

| | |
|---|---|
| ***F25B 43/04*** | (2006.01) |
| ***F25B 47/00*** | (2006.01) |
| ***F25B 49/00*** | (2006.01) |
| ***F25B 25/00*** | (2006.01) |
| *F25B 1/053* | (2006.01) |
| *F25B 39/04* | (2006.01) |

(52) U.S. Cl.
CPC ..... *F25B 43/043* (2013.01); *F25B 47/003* (2013.01); *F25B 49/005* (2013.01); *F25B 49/02* (2013.01); *F25B 1/053* (2013.01); *F25B 39/04* (2013.01); *F25B 2313/0316* (2013.01); *F25B 2339/046* (2013.01); *F25B 2339/047* (2013.01); *F25B 2341/0662* (2013.01); *F25B 2400/13* (2013.01); *F25B 2400/23* (2013.01); *F25B 2500/19* (2013.01); *F25B 2700/195* (2013.01); *F25B 2700/21152* (2013.01); *F25B 2700/21161* (2013.01); *F25B 2700/21163* (2013.01)

(58) Field of Classification Search
CPC ..... F25B 47/003; F25B 49/02; F25B 49/022; F25B 2313/0316; F25B 2339/046; F25B 2339/047; F25B 2341/0662; F25B 2400/13; F25B 2400/23; F25B 2500/19; F25B 2700/21152; F25B 2700/21161; F25B 2700/21163
See application file for complete search history.

(56) References Cited

FOREIGN PATENT DOCUMENTS

| | | | |
|---|---|---|---|
| JP | 62-80474 | A | 4/1987 |
| JP | 1-217168 | A | 8/1989 |
| JP | 4-335973 | A | 11/1992 |
| JP | 7-280398 | A | 10/1995 |
| JP | 2004-92928 | A | 3/2004 |
| JP | 2008-96027 | A | 4/2008 |
| JP | 2011-75208 | A | 4/2011 |
| JP | 2011-133192 | A | 7/2011 |

OTHER PUBLICATIONS

Written Opinion of the International Searching Authority (Form PCT/ISA/237) for International Application No. PCT/JP2016/069482, dated Sep. 20, 2016, with English translation.

* cited by examiner

REFRIGERATING MACHINE AND CONTROL METHOD THEREFOR

TECHNICAL FIELD

The present invention relates to a refrigerating machine and a control method therefor.

BACKGROUND ART

In the related art, HFC refrigerant used in refrigerating machines and heat pumps has Global Warming Potential (GWP) of several hundred to several thousand and thus, it is necessary to switch from HFC refrigerant to HFO refrigerant (for example, HPO-1233zd of HPO-1234ze) having GWP less than 10. HFO-1233zd(E), which is not combustible, has a boiling point of approximately 18° C. Accordingly, in a case where HFO-1233zd(E) is used as a refrigerant for a refrigerating machine, a pressure in an evaporator becomes a negative pressure, and thus, entering of air into the refrigerating machine is concerned. If air enters the refrigerating machine, there is a concern that performance deterioration of the refrigerating machine is generated due to an increase in a condensation pressure and a failure and stopping of the refrigerating machine are generated due to an increase in abnormality. In addition, if water inside the refrigeration machine and oxygen of the entering air are combined to each other, there is a concern that rust occurs and the refrigerating machine (particularly, compressor) deteriorates.

As a technology for extracting a noncondensable gas such as air entering the refrigerating machine is known in PTLs below.

CITATION LIST

Patent Literature

[PTL 1] Japanese Unexamined Patent Application Publication No. 62-80474

[PTL 2] Japanese Unexamined Patent Application Publication No. 1-217168

[PTL 3] Japanese Unexamined Patent Application Publication No. 4-335973

[PTL 4] Japanese Unexamined Patent Application Publication No. 7-280398

[PTL 5] Japanese Unexamined Patent Application Publication No. 2011-133192

[PTL 6] Japanese Unexamined Patent Application Publication No. 2011-75208

SUMMARY OF INVENTION

Technical Problem

However, there is a known technique of performing air bleeding in a case where a certain amount of a noncondensable gas such as air accumulates in the refrigerating machine arid performance of the refrigerating machine clearly decreases. However, a technology of performing air bleeding regularly at an appropriate timing to maintain effective performance of the refrigerating machine has not been established yet.

Particularly, in a case of a shell-and-tube type condenser, air accumulates inside a pipe group formed by a plurality of heat transfer tubes, and air freely moves in a longitudinal direction of the condenser. Accordingly, a position of the air accumulation cannot be specified and it is not possible to reliably perform air bleeding.

The present invention is made in consideration of the above-described circumstances, and an object thereof is to provide a refrigeration machine capable of accurately detecting accumulation of a noncondensable gas such as air inside the refrigerating machine and a control method therefor.

In addition, another object of the present invention is to provide a refrigerating machine capable of effectively extracting a noncondensable gas accumulated inside the refrigerating machine and a control method therefor.

Solution to Problem

In order to achieve one object, a refrigerating machine of the present invention and a control method therefor adopts the following means.

That is, according to an aspect of the present invention, there is provided a refrigerating machine, including: a compressor which compresses a refrigerant; a condenser which includes at least one pipe group configured of a plurality of heat transfer pipes through which a cooling medium flows and condenses the refrigerant compressed by the compressor; an expansion valve which expands the refrigerant condensed by the condenser; an evaporator which evaporates the refrigerant expanded by the expansion valve; a temperature sensor which measures a cooling medium outlet temperature which is a temperature of the cooling medium which flows out from at least one heat transfer pipe configuring the pipe group; and a control unit which determines, on the basis of the temperature measured by the temperature sensor, an air bleeding start state in which an air bleeding operation to extract a noncondensable gas to the outside starts.

If the noncondensable gas stays inside the pipe groups of the condenser and outside the heat transfer pipes, a heat transfer coefficient to the outside of the pipe decreases, heat transfer between a cooling medium (for example, cooling water) flowing through the heat transfer pipes and a refrigerant outside the heat transfer pipes decreases, and a cooling medium outlet temperature is higher than that of a normal case where the noncondensable gas does not exist. That is, by providing the temperature sensor which measures an outlet temperature of the cooling medium flowing out from at least one heat transfer pipe of the pipe groups, on the basis of the temperature measured by the temperature sensor, the air bleeding start state in which the air bleeding operation to extract the noncondensable gas accumulated inside the refrigerating machine to the outside starts is determined using the above-described phenomenon. Accordingly, it is possible to accurately detect the noncondensable gas being accumulated inside the refrigerating machine, and it is possible to start the air bleeding operation at an appropriate timing.

Moreover, in the above-described refrigerating machine, the control unit stores, as a reference condenser termination temperature difference in a case where desired heat transfer is performed in the pipe group, a condenser termination temperature difference which is a difference between a saturation temperature determined by a pressure inside the condenser and a cooling medium outlet temperature in a storage unit according to refrigerating capability within an operable range, and in a case where a current condenser termination temperature difference which is a difference between a saturation temperature determined by a current pressure inside the condenser and a current cooling medium outlet temperature measured by the temperature sensor is greater than the reference condenser termination temperature difference, it is determined that the state is in the air bleeding start state.

With respect to the condenser termination temperature difference which is the difference between the saturation temperature determined by the pressure inside the condenser and the cooling medium outlet temperature, if a current value is greater than the reference value, which means that heat transfer is not preferably performed in the pipe group, that is, the noncondensable gas exists to an extent that heat transfer is inhibited. Accordingly, in a case where the current condenser termination temperature difference is greater than the reference condenser termination temperature difference, it is determined that the state is in the air bleeding operation start state.

In addition, since the reference condenser termination temperature difference is determined according to the refrigerating capability within the operable range, the air bleeding operation start state can be appropriately determined according to the operation state of the refrigerating machine.

Moreover, according to another aspect of the present invention, there is provided a refrigerating machine, including: a compressor which compresses a refrigerant; a condenser which condenses the refrigerant compressed by the compressor; an expansion valve which expands the refrigerant condensed by the condenser; an evaporator which evaporates the refrigerant expanded by the expansion valve; an air bleeding device which is connected to the condenser and extracts noncondensable gas to the outside; and a control unit which increases an opening degree of the expansion valve before operating the air bleeding device.

By increasing the opening degree of the expansion valve, a circulation air volume of the evaporator increases and the noncondensable gas staying in the evaporator can flow to the suction side of the compressor to be introduced to the condenser. Accordingly, it is possible to effectively extract the noncondensable gas accumulated inside the evaporator.

In addition, in a case where an economizer is provided between the condenser and the evaporator, an opening degree of a low stage expansion valve provided between the economizer and the evaporator increases.

In addition, the above-described refrigerating machine further includes a hot gas bypass pipe which is connected to the condenser and the evaporator, and a hot gas bypass valve which is provided in the hot gas bypass pipe, the control unit increases an opening degree of the hot gas bypass valve before operating the air bleeding device.

By increasing the opening degree of the hot gas bypass valve, a hot gas inside the evaporator flows into the evaporator. The noncondensable gas staying in the evaporator to which the hot gas bypass pipe is connected can flow to the suction side of the compressor along with the hot gas so as to be introduced to the condenser.

In addition, in the above-described refrigerating machine, after the control unit increases the opening degree of the hot gas bypass valve, the control unit returns the opening degree of the hot gas bypass valve to an opening degree before increasing, and after a predetermined time elapses, the control unit gradually increases the opening degree of the hot gas bypass valve within a range of a predetermined value or less.

After the opening degree of the hot gas bypass valve increases, if the opening degree is returned to the opening degree before increasing and a predetermined time elapses, the noncondensable gas expelled from the inside of the evaporator is collected inside the condenser via the compressor. Thereafter, by gradually increasing the opening degree of the hot gas bypass valve within a range of a predetermined value or less, the noncondensable gas staying in the condenser moves to a connection portion side of the hot gas bypass pipe, and it is possible to move the noncondensable gas to a desired position. For example, if the connection portion to the air bleeding device is positioned on the hot gas bypass pipe side with respect to the center position of the condenser, the noncondensable gas staying on a side far from the center position of the condenser when viewed from the hot gas bypass pipe can be introduced to the position at which the air bleeding device is connected, and thus, the air bleeding is easily performed.

The opening degree of the hot gas bypass valve is set to the range of the predetermined value or less. The opening degree or the predetermined position or less is an opening degree of an extent that it avoids sucking the noncondensable gas from the hot gas bypass pipe. In order to avoid sucking the noncondensable gas from the hot gas bypass pipe, preferably, the opening degree of the hot gas bypass valve gradually increases, and for example, the opening degree increases at a speed of 1%/sec.

Moreover, the above-described refrigerating machine further includes an economizer which is provided between the condenser and the evaporator, an intermediate suction pipe which connects the economizer and an intermediate suction port of the compressor to each other, and intermediate suction flow rate control means for controlling an intermediate suction flow rate of the compressor, in which the control unit increases a flow rate of the intermediate suction flow rate control means before operating the air bleeding device.

By increasing the intermediate suction flow rate, the flow rate inside the economizer increases, and the noncondensable gas staying in the economizer can flow to the intermediate suction port of the compressor to be introduced to the condenser.

For example, in a case where the compressor is a two-stage turbocompressor, the intermediate suction flow rate control means may be a second vane.

In addition, in the above-described refrigerating machine, the control unit decreases a discharge flow rate of the compressor before operating the air bleeding device.

In the condenser, since a liquefied refrigerant stays in the lower portion thereof, the refrigerant discharged from the compressor flows from the upper portion of the condenser to the lower portion thereof. Accordingly, the noncondensable gas inside the condenser may be forced downward by the discharged refrigerant and can stay at the lower position (for example, the inside of the pipe group). Therefore, by decreasing the discharge flow rate of the compressor, a circulation air volume of the refrigerant inside the condenser decreases, and the noncondensable gas staying at the lower position (for example, the inside of the pipe group) of the condenser can move upward to be collected at the upper portion of the condenser.

For example, in the case of the turbocompressor, the means for decreasing the discharge flow rate of the compressor may be a suction vane which adjusts a suction flow rate.

In addition, according to still another aspect of the present invention, there is provided a control method of a refrigerating machine which includes a compressor which compresses a refrigerant, a condenser which includes at least one pipe group configured of a plurality of heat transfer pipes through which a cooling medium flows and condenses the refrigerant compressed by the compressor, an expansion valve which expands the refrigerant condensed by the condenser, an evaporator which evaporates the refrigerant expanded by the expansion valve, and a temperature sensor which measures a cooling medium outlet temperature which is a temperature of the cooling medium which flows out from at least one heat transfer pipe configuring the pipe group, the control method including: determining, on the basis of the temperature measured by the temperature sensor, an air bleeding start state in which an air bleeding operation to extract a noncondensable gas to the outside starts.

If the noncondensable gas stays inside the pipe groups of the condenser and outside the heat transfer pipes, a heat transfer coefficient to the outside of the pipe decreases, heat transfer between a cooling medium (for example, cooling water) passing through the heat transfer pipes and a refrigerant outside the heat transfer pipes decreases, and a cooling medium outlet temperature is higher than that of a normal case where the noncondensable gas does not exist. That is, by providing the temperature sensor which measures an outlet temperature of the cooling medium flowing out from at least one heat transfer pipe of the pipe groups, on the basis of the temperature measured by the temperature sensor, the air bleeding start state in which the air bleeding operation to extract the noncondensable gas accumulated inside the refrigerating machine to the outside starts is determined using the above-described phenomenon. Accordingly, it is possible to accurately detect the noncondensable gas being accumulated inside the refrigerating machine, and it is possible to start the air bleeding operation at an appropriate timing.

In addition, according to still another aspect of the present invention, there is provided a control method of a refrigerating machine which includes a compressor which compresses a refrigerant, a condenser which condenses the refrigerant compressed by the compressor, an expansion valve which expands the refrigerant condensed by the condenser, an evaporator which evaporates the refrigerant expanded by the expansion valve, and an air bleeding device which is connected to the condenser and extracts a noncondensable gas to the outside, the control method including: increasing an opening degree of the expansion valve before operating the air bleeding device.

By increasing the opening degree of the expansion valve, a circulation air volume of the evaporator increases and the noncondensable gas staying in the evaporator can flow to the suction side of the compressor to be introduced to the condenser. Accordingly, it is possible to effectively extract the noncondensable gas accumulated inside the evaporator.

In addition, in a case where an economizer is provided between the condenser and the evaporator, an opening degree of a low stage expansion valve provided between the economizer and the evaporator increases.

Advantageous Effects of Invention

It is possible to accurately detect the noncondensable gas such as air being accumulated inside the refrigerating machine by the temperature sensor which measures the cooling medium outlet temperature.

The noncondensable gas staying at each location inside the refrigerating machine moves to the condenser before the air bleeding device is activated. Accordingly, it is possible to effectively extract the noncondensable gas accumulated inside the refrigerating machine.

DESCRIPTION OF EMBODIMENTS

Hereinafter, an embodiment according to the present invention will be described with reference to the drawings.

Figure 1:
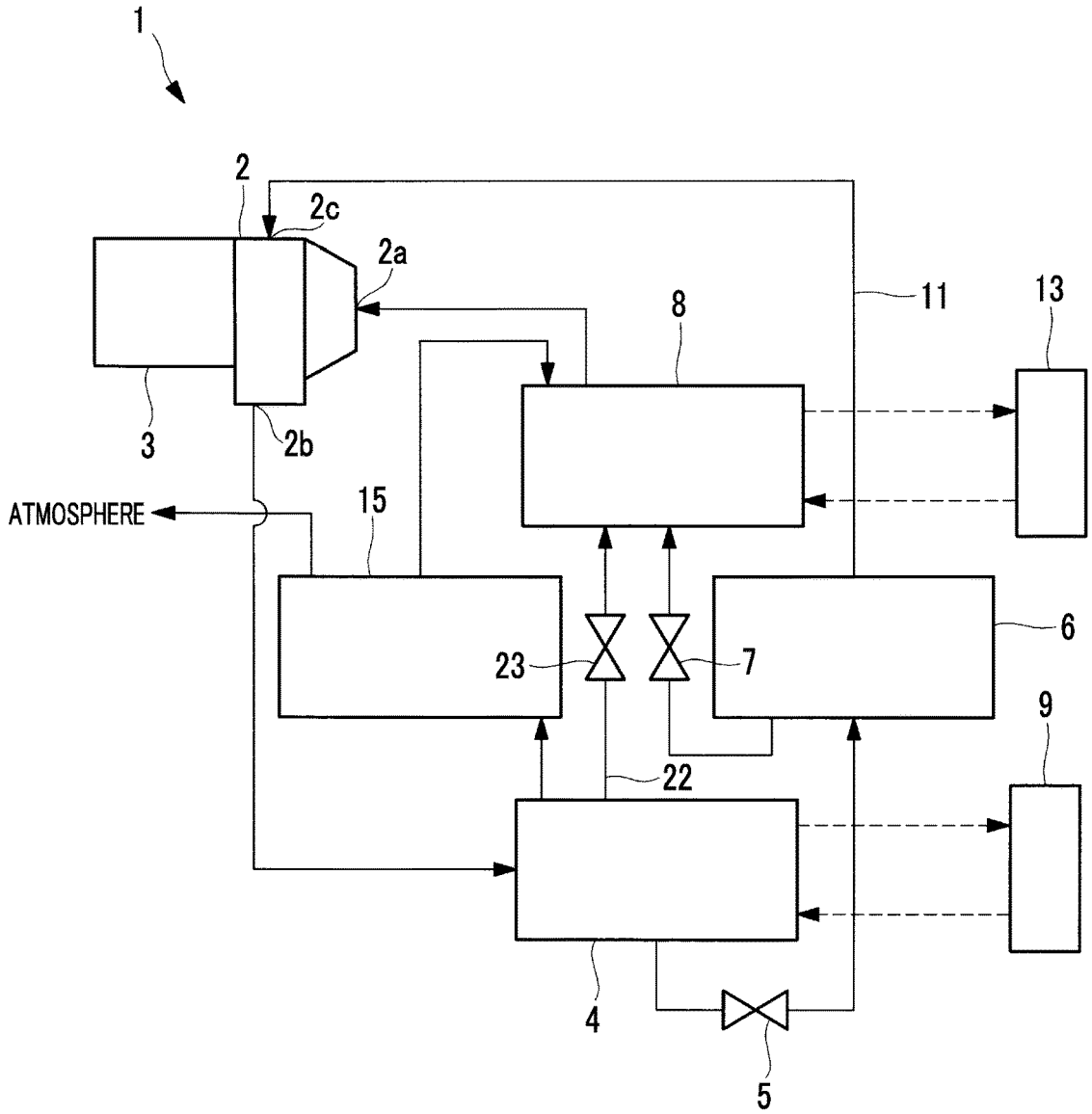
FIG. 1 is a schematic configuration diagram showing a turbo refrigerating machine according to an embodiment of the present invention.

As shown in FIG. 1, a turbo refrigerating machine 1 includes a turbocompressor 2, an electric motor 3 which drives the turbocompressor 2, a condenser 4, a high stage expansion valve 5, an economizer 6, a low stage expansion valve 7, an evaporator 8, or the like, and these devices are connected to each other by refrigerant pipes to configure a refrigeration cycle of a closed cycle.

For example, as a refrigerant used in the turbo refrigerating machine 1, a refrigerant such as HFO-1223zd(E) in which a pressure inside an evaporator is a negative pressure is used. However, the present invention is not limited to this.

The turbocompressor 2 and the electric motor 3 configure an electric compressor having a closed structure in which housings thereof are integrally connected to each other, and in the present embodiment, the turbocompressor 2 is a two-stage compressor, the motor 3 is an inverter-driven electric motor, and the turbocompressor 2 can be driven by a rotation of a shaft of the electric motor 3.

Although not shown, a first vane and a second vane which adjust a flow rate of an inflow refrigerant are respectively provided on inlet sides of a first impeller and a second impeller configuring the two-stage turbocompressor 2. An opening degree of the vane is controlled by a control unit (not shown).

The condenser 4 is a shell-and-tube type heat exchanger, in which cooling water (cooling medium) cooled by a cooling tower 9 flows through a plurality of heat transfer pipes, a high-pressure refrigerant gas introduced from a discharge port 2*b* of the turbocompressor 2 is cooled to be condensed and liquefied, and thus, a sub-cool liquid is generated.

The economizer 6 performs gas-liquid separation on a refrigerant which is decompressed to an intermediate pressure by the high stage expansion valve 5 and introduces a gas refrigerant to an intermediate suction port 2*c* between the first stage and the second stage of the two-stage turbo compressor 2 through an intermediate suction pipe 11.

The evaporator 8 is a shell-and-tube type heat exchanger, performs heat exchange between cold water returned from a load 13 side and a low-pressure refrigerant decompressed by the low stage expansion valve 7 to cool the cold water to a predetermined temperature, and discharges the cold water to the load 13 side. The turbocompressor 2 sucks a low-pressure refrigerant gas evaporated by the evaporator 8 from a suction port 2*a*, compresses the low-pressure refrigerant in a two-stage compression manner to generate a high-pressure refrigerant gas again, and discharges the refrigerant gas to the condenser 4. The turbo refrigerating machine 1 is configured to repeat this cycle to cool the cold water by the evaporator 8.

Figure 2:
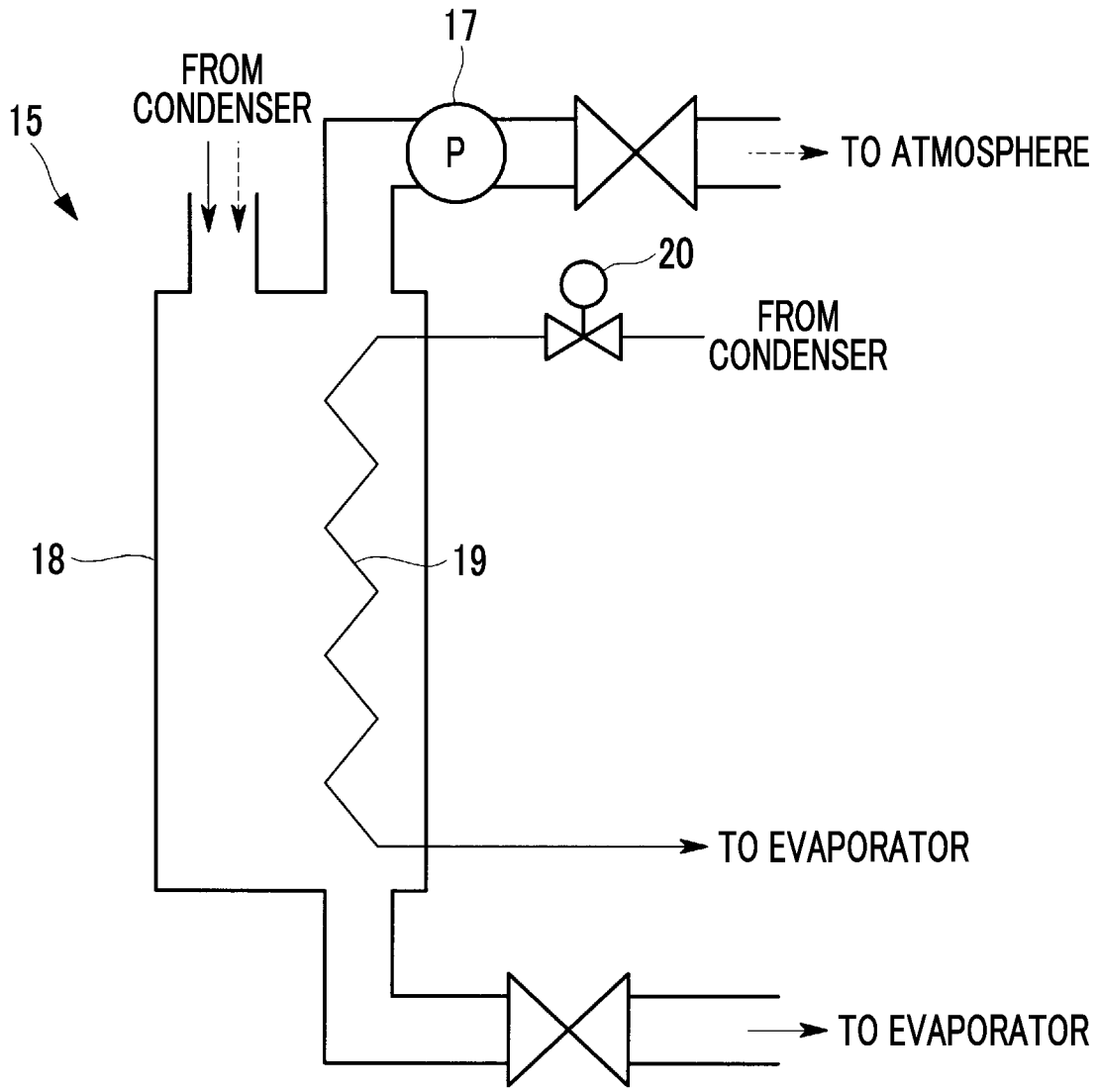
FIG. 2 is a longitudinal sectional diagram schematically showing an air bleeding device in FIG. 1.

An air bleeding device 15 is provided between the condenser 4 and the evaporator 8. The air bleeding device 15 extracts air (noncondensable gas) accumulated in the turbo refrigerating machine 1 and discharges the air to the outside of the turbo refrigerating machine 1. As shown in FIG. 2, the air bleeding device 15 sucks the air extracted from the condenser 4 and the accompanying refrigerant, and cools the air and refrigerant by a cooling coil 19 in the gas-liquid separation container 18 to perform gas-liquid separation. In the cooling coil 19, a liquid refrigerant is introduced from the condenser 4, and the liquid refrigerant is expanded by an expansion valve 20 for a cooling coil to obtain a cold heat. The refrigerant which passes through the cooling coil 19 is introduced to the evaporator 8. In addition, the cooling coil 19 may adopt other methods as long as it can cool the gas introduced into the gas-liquid separation container 18, and for example, a method using cooling water or cold water may be adopted.

The liquid refrigerant separated from the gas-liquid separation container 18 is taken out from the lower portion to be introduced to the evaporator 8. Air separated from the gas-liquid separation container 18 is discharged from the upper portion to the atmosphere via an exhaust pump 17.

As shown in FIG. 1, a hot gas bypass pipe 22 in which a hot gas bypass valve 23 is provided is connected to a portion between the condenser 4 and the evaporator 8.

The control of the turbo refrigerating machine 1 is performed by a control unit (not shown). In the present embodiment, a determination to start an air bleeding operation or a sequence of the air bleeding operation is performed by the control unit.

For example, the control unit is configured of a Central Processing Unit (CPU), a Random Access Memory (RAM), a Read Only Memory (ROM), a computer readable storage medium, or the like. In addition, for example, a series of processing for realizing various functions is stored in a storage medium or the like as a program form, the CPU reads the program using the RAM or the like to execute information processing and calculation processing, and thus, various functions are realized. In addition, a form in which the program is installed in the ROM or other storage mediums in advance, a form in which the program is provided in a state of being stored in a computer readable storage medium, a form in which the program is delivered via wired or wireless communication means, or the like may be adopted. The computer readable storage medium includes a magnetic disk, a magneto optical disk, a CD-ROM, a DVD-ROM, a semiconductor memory, or the like.

Next, a specific configuration of the condenser 4 will be described with reference to FIGS. 3 to 5.

Figure 3:
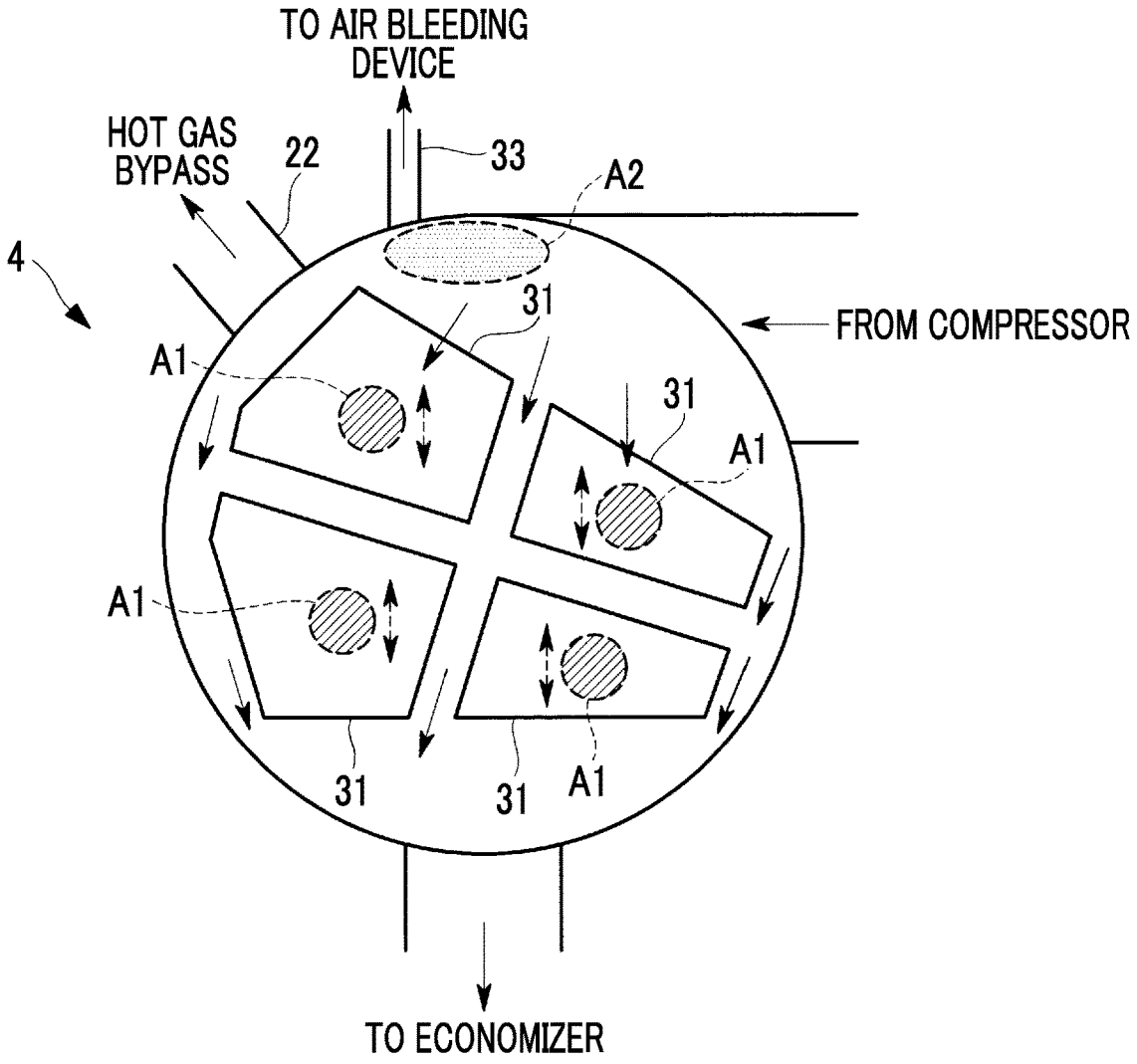
FIG. 3 is a cross sectional diagram schematically showing a condenser in FIG. 1.
Figure 4:
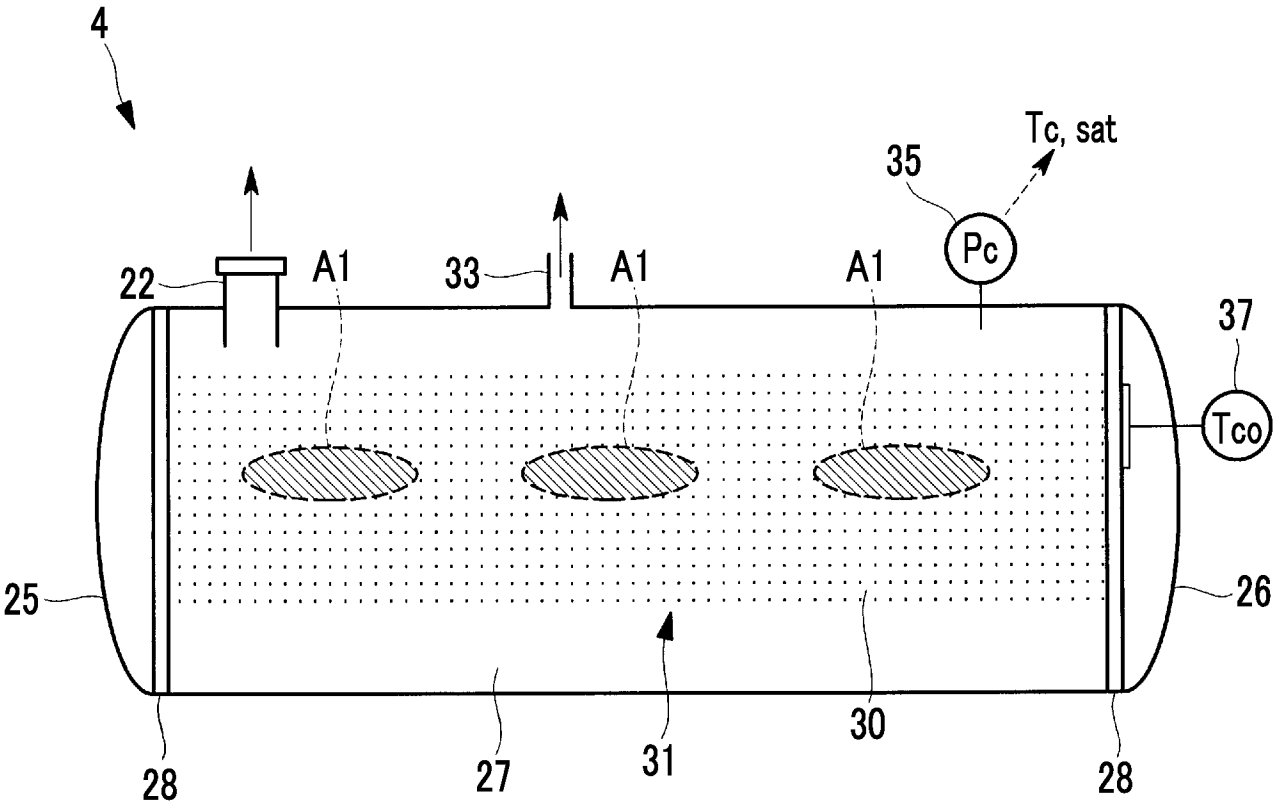
FIG. 4 is a longitudinal sectional diagram schematically showing the condenser in FIG. 1.

As shown in FIGS. 3 and 4, the container of the condenser 4 is formed in a cylindrical shape having an approximately circular cross section and a horizontal axis. As shown in FIG. 4, water chambers to which cooling water is introduced are provided on both side portions of the condenser 4, a space interposed between water chambers 25 and 26 becomes a condensation chamber 27 in which a refrigerant introduced from the turbocompressor 2 is condensed. Portions between the water chambers 25 and 26 and the condensation chamber 27 are partitioned by pipe plates 28.

A plurality of heal transfer pipes 30 are connected to each other between the water chambers 25 and 26. Accordingly, cooling water flows through each heat transfer pipe 30 and a refrigerant exists outside each heat transfer pipe 30. In addition, in FIG. 4, regions in which the plurality of heat transfer pipes 30 exist are shown by hatching. As shown in FIG. 3, the heat transfer pipes 30 form a plurality of pipe groups 31. In FIG. 3, four pipe groups 31 are provided. In each pipe group 31, the plurality of heat transfer pipes 30 are disposed in a bundle at predetermined intervals. Predetermined gaps are provided between the pipe groups 31 and a refrigerant can flow through the gaps.

As shown FIGS. 3 and 4, an air bleeding pipe 33 and the hot gas bypass pipe 22 connected to the air bleeding device 15 are provided to the upper portion of the condenser 4. As shown FIG. 4, the air bleeding pipe 33 is provided on the hot gas bypass pipe 22 side from a center position of the condenser 4 in an axial direction.

A pressure sensor 35 which measures an internal pressure of the condenser 4 is provided in the condenser 4. An output of the pressure sensor 35 is sent to the control unit and saturation temperatures Tc,sat is obtained.

As shown in FIG. 4, a temperature sensor 37 for measuring an outlet temperature of the cooling water is provided on outflow sides of the heat transfer pipes 30. As shown in FIG. 5, the temperature sensor 37 is disposed to be inserted into the heat transfer pipe 30. In addition, a tip side of the temperature sensor 37 is formed in a coil shape to come into contact with an inner periphery of the heat transfer pipe 30, and ideally, a measurement point 37*a* of the tip is disposed on the center axis of the heat transfer pipe 30 in a state of being separated from a wall portion of the heat transfer pipe 30. Accordingly, it is possible to correctly measure the temperature of the cooling water flowing through the heat transfer pipe 30.

The temperature sensor 37 is provided in each of all the heat transfer pipes 30. However, preferably, the temperature sensor 37 is provided in the plurality of representative heat transfer pipes 30. The representative heat transfer pipe 30 is a heat transfer pipe having high possibility of generating an air accumulation A1, and for example, the heat transfer pipe 30 inside positioned in each pipe group 31 is selected as the representative heat transfer pipe 30.

In FIGS. 3 and 4, the air accumulations A1 are shown. The air accumulations A1 are formed inside the pipe group 31 and are factors which inhibit the heat transfer of the heat transfer pipe 30. It is considered that air is forcibly introduced into the pipe groups 31 by the flow of the refrigerant supplied from the turbocompressor 2, the refrigerant is liquefied inside the pipe groups 31 and noncondensable air remains and stays at the site, and thus, the air accumulations A1 are formed in the pipe groups 31.

In FIG. 3, an air accumulation A2 staying in the upper portion of the condenser 4 is shown. The air accumulation A2 shows a state where an air volume of the refrigerant from the turbocompressor 2 decreases and the air accumulations A1 positioned in the pipe groups 31 rises.

Figure 6:
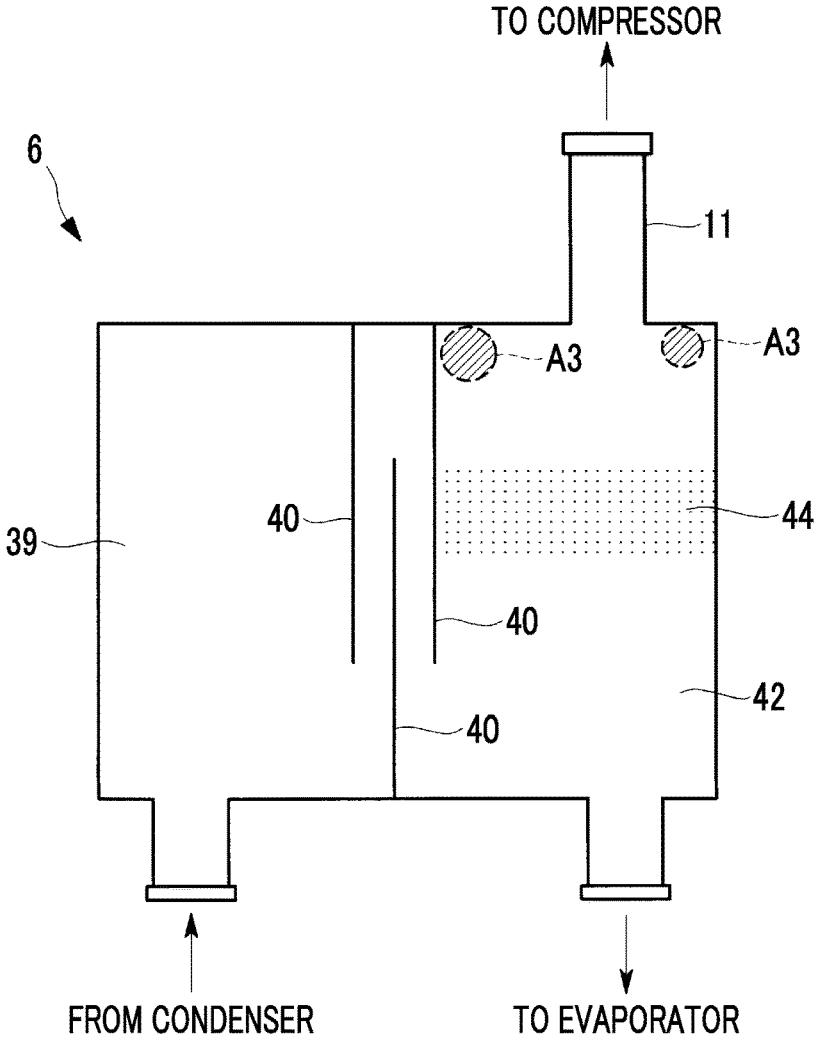
FIG. 6 is a longitudinal sectional diagram schematically showing an economizer in FIG. 1.

FIG. 6 shows a schematic configuration of the economizer 6. In the economizer 6, the refrigerant from the condenser 4 is introduced to the upstream chamber 39. The upstream chamber 39 is connected to a downstream chamber 42 by a meandering flow path formed by a plurality of partition plates 40. A demister 44 is installed in the downstream chamber 42 to remove mist from the refrigerant gas which is subjected to gas-liquid separation in the downstream chamber 42. The refrigerant gas which passes through the demister 44 is introduced to the intermediate suction port 2*c* of the turbocompressor 2 through the intermediate suction pipe 11 connected to the upper portion. The liquid refrigerant subjected to the gas-liquid separation in the: downstream chamber 42 is extracted from the lower portion to be introduced to the evaporator 8.

As shown in FIG. 6, an air accumulation A3 is formed at the upper portion of the downstream chamber 42 inside the economizer 6.

Figure 7:
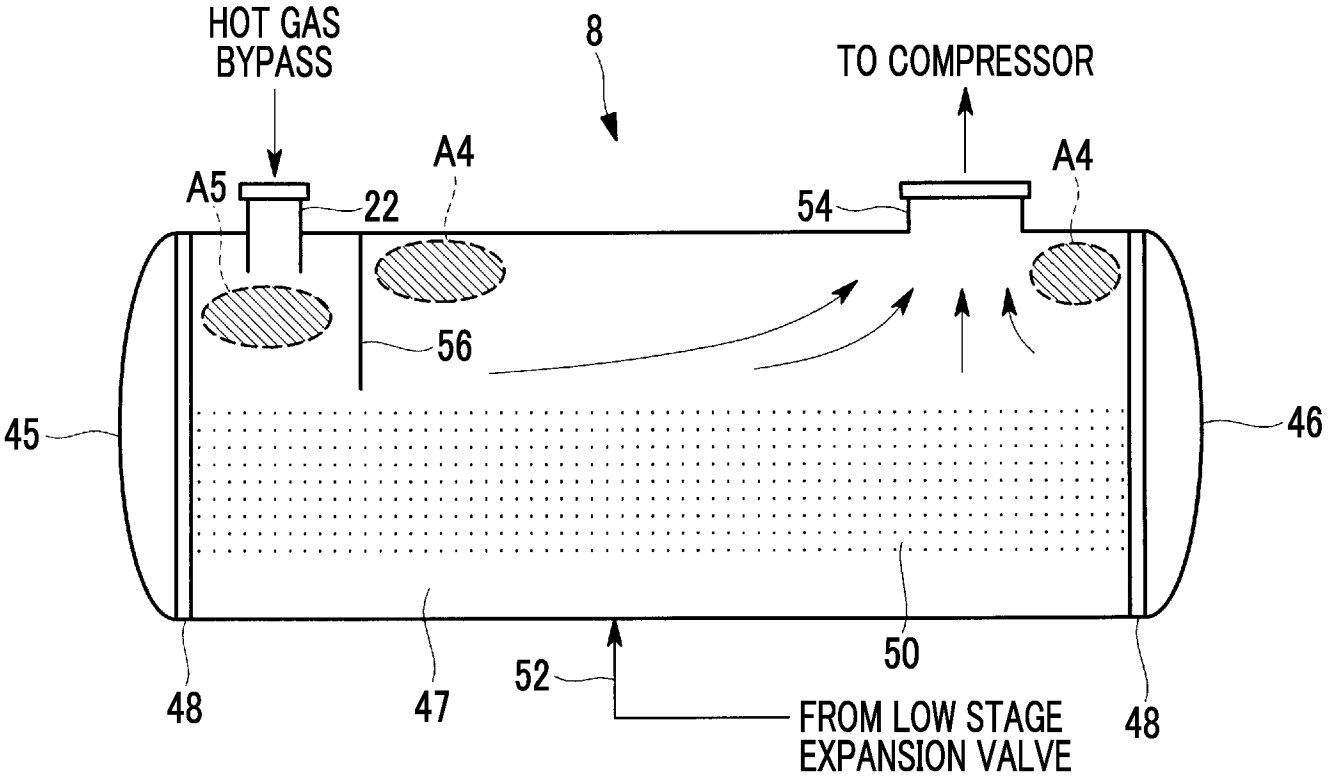
FIG. 7 is a longitudinal sectional diagram schematically showing an evaporator in FIG. 1.

FIG. 7 shows a schematic configuration of the evaporator 8. Similarly to the condenser 4, the evaporator 8 is a shell-and-tube type container and is a container formed in a cylindrical shape having an approximately circular cross section and a horizontal axis. Water chambers to which cold water is introduced are provided on both side portions of the evaporator 8, a space interposed between water chambers 45 and 46 becomes an evaporation chamber 47 in which a refrigerant introduced from the economizer 6 exists. Portions between the water chambers 45 and 46 and the evaporation chamber 47 are partitioned by pipe plates 48.

A plurality of heat transfer pipes 50 are connected to each other between the water chambers 45 and 46. The heat transfer pipes 50 configure a plurality of pipe groups.

A refrigerant pipe 52 to which the refrigerant introduced from the economizer 6 is introduced is connected to the lower portion of the evaporator 8. A suction pipe 54 through which the refrigerant gas evaporated inside the evaporator 8 is introduced to the suction port 2*a* of the turbocompressor 2 is connected to the upper portion of the evaporator 8. In addition, the hot gas bypass pipe 22 is connected to the end portion of the upper portion of the evaporator 8. The connection portion of the hot gas bypass pipe 22 is partitioned from other areas by a partition plate 56. A hot gas introduced from the hot gas bypass pipe 22 is introduced to the heat transfer pipes 50 positioned at the lower portion by the partition plate 56.

In the evaporator 8, air accumulations A4 are formed at the upper portion of the evaporator 8, and an air accumulation A5 is formed in the vicinity of the connection portion of the hot gas bypass pipe 22 partitioned by the partition plate 56.

The turbo refrigerating machine 1 having the above-described configuration is operated as follows.

A refrigerant sucked to the turbocompressor 2 from the suction port 2*a* is compressed in a two-stage compression manner and introduced to the condenser 4.

In the condenser 4, the refrigerant is cooled by cooling water introduced from the cooling tower 9 and is condensed and liquefied to generate the sub-cool liquid. The sub-cool liquid generated in the condenser 4 is throttled by the high stage expansion valve 5 and thereafter, is introduced to the economizer 6.

In the economizer 6, the refrigerant is subjected to gas-liquid separation, the liquid refrigerant is introduced to the low stage expansion valve 7 to be throttled, and thereafter, is introduced to the evaporator 8. The gas refrigerant generated by the gas-liquid separation in the economizer 6 is introduced to the intermediate suction port 2*c* of the turbocompressor 2 through the intermediate suction pipe 11.

In the evaporator 8, the refrigerant is evaporated by cooling the cold water introduced from the load 13. The evaporated gas refrigerant is introduced to the suction port 2*a* of the turbocompressor 2 and repeats the above-described processes.

While the above-described refrigeration cycle is performed, air enters the turbo refrigerating machine 1 from the atmosphere.

For example, in a where a refrigerant such as HFO-1233zd(E) in which a pressure inside the evaporator 8 is a negative pressure is used, it is considered that air enters the inside from the evaporator 8. If the air enters the turbo refrigerating machine 1 and is accumulated, a disadvantage in which performance of the refrigerating machine decreases or the like occurs. Accordingly, the air bleeding device 15 is activated to discharge the air inside the turbo refrigerating machine 1 to the outside.

<Determination of Air Bleeding Start State>

A timing to start an air bleeding operation is determined as follow by the control unit.

Figure 5:
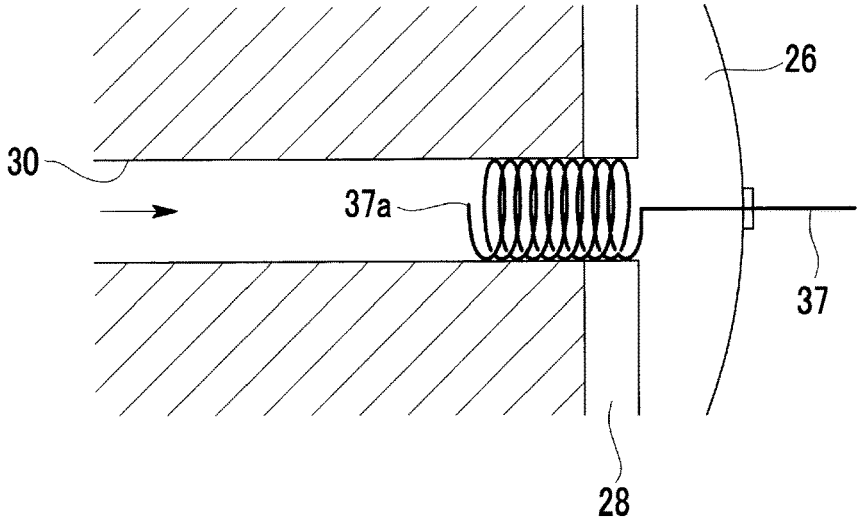
FIG. 5 is a partially longitudinal sectional diagram showing an attachment state of a temperature sensor.

As shown in FIGS. 4 and 5, the timing to start the air bleeding is determined by the temperature sensor 37 provided in the outlet of the heat transfer pipe 30 of the condenser 4. This is because if air stays inside the pipe groups 31 of the condenser 4, a heat transfer coefficient to the outside of the pipe decreases, heat transfer between the cooling water passing through the heat transfer pipes 30 and the refrigerant outside the heat transfer pipes 30 decreases, and a phenomenon that the cooling water outlet temperature is higher than that of a normal case where the air accumulations A1 do not exist can be used.

Figure 8:
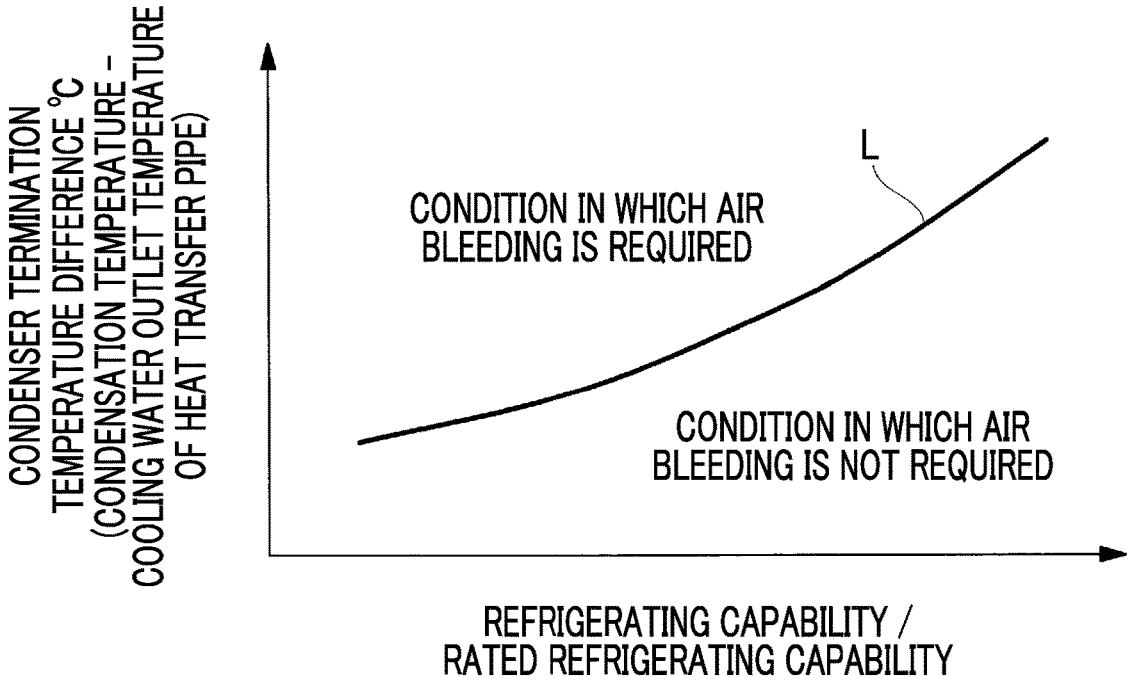
FIG. 8 is a graph showing a condenser termination temperature difference for determining an air bleeding start state.

Specifically, the control unit includes a map and a relationship expression reflecting a graph shown in FIG. 8. In FIG. 8, a horizontal axis indicates a value obtained by dividing refrigerating capability by rated refrigerating capability and indicates a value obtained by normalizing the refrigerating capability of the turbo refrigerating machine 1 with the rated refrigerating capability. A vertical axis is a condenser termination temperature difference and indicates a value obtained by subtracting a cooling water outlet temperature measured by the temperature sensor 37 from a saturation temperature (condensation temperature) obtained from a pressure measured by the pressure sensor 35.

A curve L indicates a reference condenser termination temperature difference and is determined by performing a test or simulation in advance. If a temperature is higher than the reference condenser termination temperature difference, heat transfer between the cooling water and the refrigerant is not sufficiently performed, and it is determined that there are air accumulations A1 which cannot be ignored in the pipe groups 31.

In addition, in a case where a current condenser termination temperature difference which is a difference between a current saturation temperature determined by the pressure sensor 35 and a current cooling water outlet temperature measured by the temperature sensor 37 is greater than the reference condenser termination temperature difference, the control unit determines that the state is in an air bleeding operation start state and determines a timing of activation of the air bleeding device 15.

<Pre-Air Bleeding Start Operation>

If the start of the air bleeding operation is determined as described above, a pre-air bleeding start operation is performed as follow before the air bleeding operation starts. That is, a preparation operation of moving not only air staying in the condenser 4 but also air staying in the evaporator 8 or the economizer 6 to the condenser 4 and further moving the air to the upper portion of the condenser 4 is performed.

As shown in FIG. 7, in order to discharge the air accumulations A4 positioned at the upper portion of the evaporator 8 to the turbocompressor 2 side, an opening degree of the low stage expansion valve 7 is increased by a command of the control unit. In this way, by increasing the opening degree of the low stage expansion valve 7, a circulation air volume of the evaporator 8 increases and the air accumulations A4 staying in the evaporator 8 flows to the suction side of the turbocompressor 2 to be introduced to the condenser 4.

As shown in FIG. 7, the air accumulation A5 exists in the region in which the connection portion of the hot gas bypass pipe 22 partitioned by the partition plate 56 is provided at the upper portion of the evaporator 8. In order to discharge the air accumulation A5 to the turbocompressor 2 side, an opening degree of the hot gas bypass valve 23 is increased by a command of the control unit. Accordingly, a hot gas flows into the evaporator 8 and the air accumulation A5 flows to the suction side of the turbocompressor 2 along with the hot gas to be introduced to the condenser 4.

Next, the above-described opening degrees of the low stage expansion valve 7 and the hot gas bypass valve 23 are returned to the opening degrees before the pre-air bleeding start operation is performed. Moreover, an opening degree of a second stage vane (not shown) provided on the upstream side of the second stage impeller of the turbocompressor 2 is increased by the command of the control unit. Accordingly, a flow rate of the refrigerant in the intermediate suction port 2*c* increases, and as a result, a flow rate inside the economizer 6 connected to the intermediate suction pipe 11 increases. Therefore, as shown in FIG. 6, the air accumulations A3 staying in the upper portion of the economizer 6 can flow to the intermediate suction port 2*c* of the turbocompressor 3 to be introduced to the condenser 4. Moreover, after a predetermined time elapses, the opening degree of the second stage vane is returned to the opening degree of the pre-air bleeding start operation starts.

According to the above-described operations, the air accumulations staying in the evaporator 8 and the economizer 6 are introduced into the condenser 4. Next, an operation of moving the air accumulations to the upper portion at which the air bleeding pipe 33 is positioned in the condenser 4 is performed.

In order to decrease a discharge flow rate of the turbocompressor 2, the opening degrees of the first stage vane and the second stage vane are decreased by the command of the control unit. Accordingly, the circulation air volume of the refrigerant inside the condenser 4 decreases, and the ear accumulations A1 staying in the pipe groups 31 of the condenser 4 can move to the upper portion by buoyancy to be collected at the upper portion of the condenser 4.

In addition, by gradually increasing the opening degree of the hot gas bypass valve 23 within a range of a predetermined value or less by the command of the control unit, the air accumulation staying in the condenser 4 moves to the connection portion side of the hot gas bypass pipe 22. As shown in FIG. 4, in the present embodiment, the connection portion of the air bleeding pips 33 is positioned on the hot gas bypass pipe 22 side with respect to the center position of the condenser 4 in the axial direction. Accordingly, the air accumulation staying on a side far from the center position of the condenser 4 in the axial direction when viewed from the hot gas bypass pipe 22 can be introduced to the connection position of the air bleeding pipe 33. Here, the opening degree of the hot gas bypass valve 23 is set to the range of a predetermined value or less. The opening degree of the predetermined position or less is an opening degree of an extent that it avoids sucking air from the hot gas bypass pipe 22. In order to avoid sucking air from the hot gas bypass pipe 22, preferably, the opening degree of the hot gas bypass valve 23 gradually increases, and for example, the opening degree increases at a speed of 1%/sec.

After the above-described pre-air bleeding start operation is completed, the air collected at the upper portion of the condenser 4 is discharged to the outside of the turbo refrigerating machine 1 by activating the air bleeding device 15 by the command of the control unit.

According to the present embodiment, the following effects are exerted.

The cooling water outlet temperature of the heat transfer pipe 30 of the condenser 4 is measured and the air bleeding operation start state is determined based on the temperature change. Accordingly, it is possible to accurately detect the air accumulations A1 being accumulated in the pipe groups 31, and it is possible to start the air bleeding operation at an appropriate timing.

In addition, by performing the pre-air bleeding start operation, air moves from the evaporator 8 and the economizer 6 to the condenser 4, and air inside the condenser 4 moves to the upper portion at which the air bleeding pipe 33 is positioned. Accordingly, it is possible to effectively extract air staying in the turbo refrigerating machine 1.

As described above, by extracting air from the inside of the turbo refrigerating machine 1, it is possible to prevent progress of corrosion of a part inside the refrigerating machine, and it is possible to prevent a decrease in performance of the refrigerating machine. In addition, it is possible to prevent an abnormal increase in a pressure inside the condenser 4, and it is possible to continue a sound operation.

REFERENCE SIGNS LIST

1: turbo refrigerating machine
2: turbocompressor
3: electric motor
4: condenser
5: high stage expansion valve
6: economizer
7: low stage expansion valve
8: evaporator
9: cooling tower
11: intermediate suction pipe
13: load
15: air bleeding device
17: exhaust pump
18: gas-liquid separation container
19: cooling coil
20: expansion valve for cooling coil
22: hot gas bypass pipe
23: hot gas bypass valve
25: water chamber
26: water chamber
27: condensation chamber
30: heat transfer pipe
31: pipe group
33: air bleeding pipe
35: pressure sensor
37: temperature sensor
39: upstream chamber
40: partition plate
42: downstream chamber
44: demister
45: water chamber
46: water chamber
47: evaporation chamber
48: pipe plate
50: heat transfer pipe
52: refrigerant pipe
54: suction pipe
56: partition plate

The invention claimed is:

1. A refrigerating machine, comprising:

a compressor which compresses a refrigerant;

a condenser which includes at least one pipe group configured of a plurality of heat transfer pipes through which a cooling medium flows and condenses the refrigerant compressed by the compressor;

an expansion valve which expands the refrigerant condensed by the condenser;

an evaporator which evaporates the refrigerant expanded by the expansion valve;

a temperature sensor which measures a cooling medium outlet temperature which is a temperature of the cooling medium which flows out from at least one heat transfer pipe configuring the pipe group; and a controller which determines, on the basis of the temperature measured by the temperature sensor, an air bleeding start state in which an air bleeding operation to extract a noncondensable gas to the outside starts.

2. The refrigerating machine according to claim 1, wherein the controller stores, as a reference condenser termination temperature difference in a case where desired heat transfer is performed in the pipe group, a condenser termination temperature difference which is a difference between a saturation temperature determined by a pressure inside the condenser and a cooling medium outlet temperature in a storage unit according to refrigerating capability within an operable range, and wherein in a case where a current condenser termination temperature difference which is a difference between a saturation temperature determined by a current pressure inside the condenser and a current cooling medium outlet temperature measured by the temperature sensor is greater than the reference condenser termination temperature difference, it is determined that the state is in the air bleeding start state.

3. A refrigerating machine, comprising:

a compressor which compresses a refrigerant;

a condenser which condenses the refrigerant compressed by the compressor;

an expansion valve which expands the refrigerant condensed by the condenser;

an evaporator which evaporates the refrigerant expanded by the expansion valve;

an air bleeding device which is connected to the condenser and extracts a noncondensable gas to the outside; and a controller which increases an opening degree of the expansion valve before operating the air bleeding device.

4. The refrigeration machine according to claim 3, further comprising:

a hot gas bypass pipe which is connected to the condenser and the evaporator; and a hot gas bypass valve which is provided in the hot gas bypass pipe, wherein the controller increases an opening degree of the hot gas bypass valve before operating the air bleeding device.

5. The refrigerating machine according to claim 4, wherein after the controller increases the opening degree of the hot gas bypass valve, the controller returns the opening degree of the hot gas bypass valve to an opening degree before increasing, and after a predetermined time elapses, the controller gradually increases the opening degree of the hot gas bypass valve within a range of a predetermined value or less.

6. The refrigerating machine according to claim 5, further comprising:

an economizer which is provided between the condenser and the evaporator;

an intermediate suction pipe which connects the economizer and an intermediate suction port of the compressor to each other; and intermediate suction flow rate control device that controls an intermediate suction flow rate of the compressor, wherein the controller increases a flow rate of the intermediate suction flow rate control device before operating the air bleeding device.

7. The refrigerating machine according to claim 5, wherein the controller decreases a discharge flow rate of the compressor before operating the air bleeding device.

8. The refrigerating machine according to claim 4, further comprising:

an economizer which is provided between the condenser and the evaporator;

an intermediate suction pipe which connects the economizer and an intermediate suction port of the compressor to each other; and intermediate suction flow rate control device that controls an intermediate suction flow rate of the compressor, wherein the controller increases a flow rate of the intermediate suction flow rate control device before operating the air bleeding device.

9. The refrigerating machine according to claim 4, wherein the controller decreases a discharge flow rate of the compressor before operating the air bleeding device.

10. The refrigerating machine according to claim 3, further comprising:

an economizer which is provided between the condenser and the evaporator;

an intermediate suction pipe which connects the economizer and an intermediate suction port of the compressor to each other; and intermediate suction flow rate control device that controls an intermediate suction flow rate of the compressor, wherein the controller increases a flow rate of the intermediate suction flow rate control device before operating the air bleeding device.

11. The refrigerating machine according to claim 10, wherein the controller decreases a discharge flow rate of the compressor before operating the air bleeding device.

12. The refrigerating machine according to claim 3, wherein the controller decreases a discharge flow rate of the compressor before operating the air bleeding device.

13. A control method of a refrigerating machine which includes a compressor which compresses a refrigerant, a condenser which includes at least one pipe group configured of a plurality of heat transfer pipes through which a cooling medium flows and condenses the refrigerant compressed by the compressor, an expansion valve which expands the refrigerant condensed by the condenser, an evaporator which evaporates the refrigerant expanded by the expansion valve, and a temperature sensor which measures a cooling medium outlet temperature which is a temperature of the cooling medium which flows out from at least one heat transfer pipe configuring the pipe group, the control method comprising;

determining, on the basis of the temperature measured by the temperature sensor, an air bleeding start state in which an air bleeding operation to extract a noncondensable gas to the outside starts.

14. A control method of a refrigerating machine which includes a compressor which compresses a refrigerant, a condenser which condenses the refrigerant compressed by the compressor, an expansion valve which expands the refrigerant condensed by the condenser, an evaporator which evaporates the refrigerant expanded by the expansion valve, and an air bleeding device which is connected to the condenser and extracts a noncondensable gas to the outside, the control method comprising:

increasing an opening degree of the expansion valve before operating the air bleeding device.

* * * * *